US010661976B2

(12) United States Patent
Muzzall et al.

(10) Patent No.: US 10,661,976 B2
(45) Date of Patent: May 26, 2020

(54) CONTAINER AND CONTAINER SYSTEM

(71) Applicant: PROVIDE COMMERCE, INC., San Diego, CA (US)

(72) Inventors: Shane Muzzall, San Diego, CA (US); Huan H. Tran, Atlanta, GA (US)

(73) Assignee: PROVIDE COMMERCE, INC., San Diego, CA (US)

( * ) Notice: Subject to any disclaimer, the term of this patent is extended or adjusted under 35 U.S.C. 154(b) by 436 days.

(21) Appl. No.: 15/094,411

(22) Filed: Apr. 8, 2016

(65) Prior Publication Data

US 2017/0291758 A1 Oct. 12, 2017

(51) Int. Cl.

| | |
|---|---|
| ***B65D 85/50*** | (2006.01) |
| ***B65D 5/02*** | (2006.01) |
| ***B65D 5/50*** | (2006.01) |
| ***B65D 77/04*** | (2006.01) |

(52) U.S. Cl.

CPC ..... *B65D 85/505* (2013.01); *B65D 5/02* (2013.01); *B65D 5/029* (2013.01); *B65D 5/50* (2013.01); *B65D 5/5007* (2013.01); *B65D 77/04* (2013.01); *B65D 77/042* (2013.01)

(58) Field of Classification Search

CPC . B65D 5/02; B65D 5/50; B65D 77/04; B65D 85/505; B65D 5/29; B65D 77/042

USPC ..... 206/144, 423, 591–594; 229/117.14; 47/65.5, 41.01, 41.13, 84

See application file for complete search history.

(56) References Cited

U.S. PATENT DOCUMENTS 1,509,809 A * 9/1924 Kaufman ..... B65D 5/02 229/117.14
1,715,583 A * 6/1929 Warren ..... B65D 81/368 229/116.4
1,763,072 A * 6/1930 Smith ..... B65D 5/46072 229/117.14
2,023,852 A * 12/1935 Oser ..... B65D 5/4612 206/486
2,992,764 A * 7/1961 Goding ..... B65D 5/2057 229/108
3,105,627 A * 10/1963 Bowdoin ..... B65D 5/242 229/117.14

(Continued)

FOREIGN PATENT DOCUMENTS

| | | |
|---|---|---|
| CN | 204979737 U | 1/2016 |
| JP | 2006206088 A | 8/2006 |
| JP | 2011042389 A | 3/2011 |

OTHER PUBLICATIONS

Written Opinion of the International Searching Authority for International Application No. PCT/US2017/026620, dated Sep. 21, 2017.

(Continued)

*Primary Examiner* — Luan K Bui

(74) *Attorney, Agent, or Firm* — Sanjeev K. Dhand; Dhand Law PC

(57) ABSTRACT

An example container includes a bottom support, a plurality of side walls and a top cover. The top cover includes a flat portion and a tented portion. In some examples, the bottom support, the side walls and the flat portion of the top cover form a rectangular box portion, and the bottom support, the side walls and the tented portion of the top cover form a tented box portion. The rectangular box portion and the tented box portion may be in communication with one another.

8 Claims, 5 Drawing Sheets

(56) References Cited

U.S. PATENT DOCUMENTS

| | | | | | |
|---|---|---|---|---|---|
| 5,392,984 | A | | 2/1995 | Yocum | |
| 5,520,284 | A | | 5/1996 | Gray | |
| D371,965 | S | | 7/1996 | Kinni | |
| 5,836,478 | A | | 11/1998 | Weiss | |
| 5,957,276 | A | * | 9/1999 | Cutler | B65D 71/0003 206/194 |
| 6,036,085 | A | | 3/2000 | Tsao | |
| D425,413 | S | | 5/2000 | Heeley | |
| D437,554 | S | | 2/2001 | Milton | |
| D438,464 | S | | 3/2001 | Newhouse | |
| D488,062 | S | | 4/2004 | Shannon | |
| D566,391 | S | | 4/2008 | McGee | |
| D575,509 | S | | 8/2008 | Evans | |
| D578,876 | S | | 10/2008 | Ambelang | |
| D606,855 | S | | 12/2009 | Jo | |
| D618,543 | S | | 6/2010 | Polaski | |
| D619,891 | S | | 7/2010 | Lymn | |
| D675,514 | S | | 2/2013 | Baker | |
| D685,633 | S | | 7/2013 | Thomas | |
| 8,522,966 | B1 | * | 9/2013 | Siebel | B65D 71/48 206/141 |
| D690,590 | S | | 10/2013 | Fux | |
| D721,954 | S | | 2/2015 | Kauanui | |
| 2003/0111521 | A1 | | 6/2003 | Holmes | |
| 2003/0168369 | A1 | * | 9/2003 | Kroeze | B65D 5/5016 206/423 |
| 2005/0061860 | A1 | * | 3/2005 | Johnson | B65D 5/0245 229/120.011 |
| 2012/0048761 | A1 | * | 3/2012 | Ginjo | B65D 77/042 206/423 |

OTHER PUBLICATIONS

Gable Top Auto Bottom. [online] Published date unknown. Retrieved on Dec. 12, 2016 from <URL:http://www.printboxpackaging.com/gable-top-auto-bottom.html>.

* cited by examiner

CONTAINER AND CONTAINER SYSTEM

BACKGROUND

Flowers are a popular gift on special occasions, as well as to show a sign of good will. Often, flowers are sent through a delivery service from a fulfillment center to the recipient. Such delivery services may ship flowers as any other item delivered by the services. Accordingly, the flowers are packaged in a box suitable for such delivery services.

BRIEF DESCRIPTION OF THE DRAWINGS

For a more complete understanding of various examples, reference is now made to the following descriptions taken in connection with the accompanying drawings in which.

DETAILED DESCRIPTION

Various examples described below provide a container which can be used to ship flowers in a protected manner. In various examples, a container includes a tented top over at least a portion of the container. The tented top may serve one or more functions. For example, the tented top can protect flowers provided therein. Further, the tented portion may serve to secure a second container in position when the container and the second container are placed within an outer container of a container system. Various examples are described in detail below.

Figure 1:
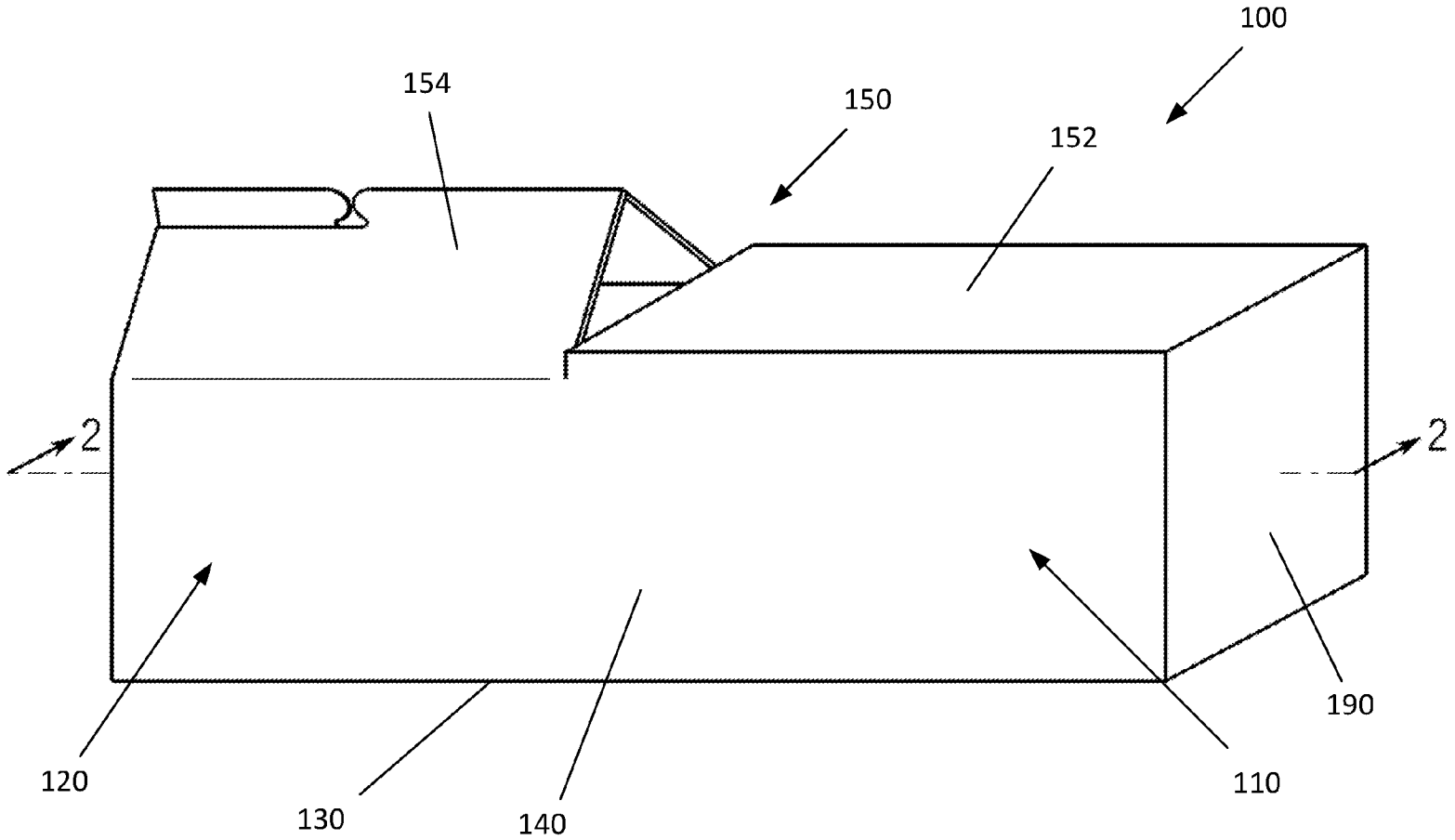
FIG. 1 illustrates a perspective view of an example container.
Figure 2:
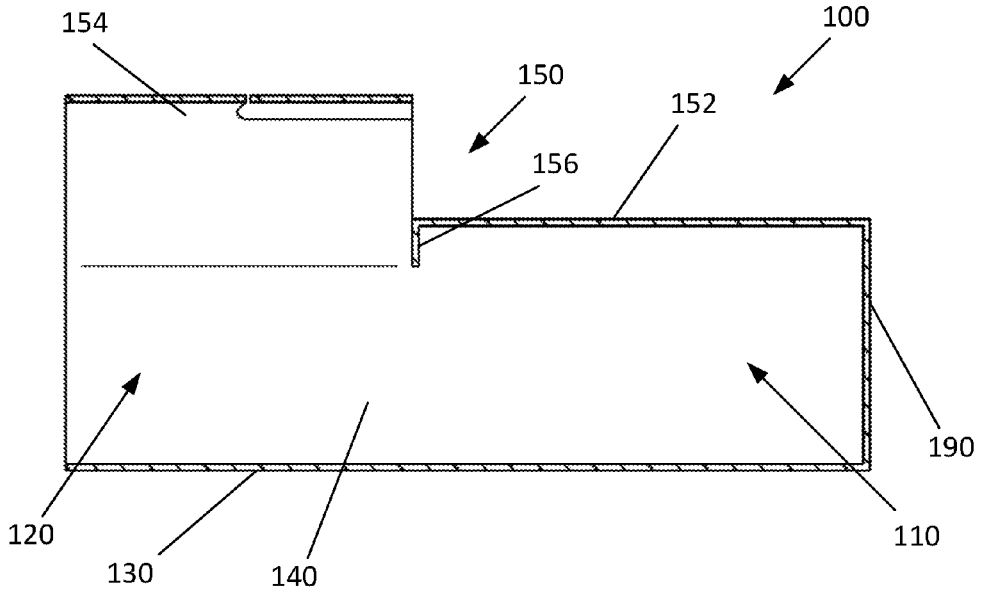
FIG. 2 illustrates a cross-sectional view of the example container of FIG. 1.

Referring first to FIG. 1, a perspective view of an example container 100 is illustrated. Further, FIG. 2 illustrates the example container 100 of FIG. 1 in a cross-sectional view taken along 2-2. In various examples, the example container 100 may be a floral container. The example container 100 includes a rectangular box portion 110 and a tented box portion 120. As illustrated most clearly in FIG. 2, the rectangular box portion 110 and the tented box portion 120 share a bottom support 130. In various examples, the bottom support 130 is substantially rectangular and sized to accommodate a bouquet of flowers with stems of a desired length. Thus, the tented box portion 120 may accommodate the flower portion with the stems extending into the rectangular box portion 110.

In the example container 100 of FIGS. 1 and 2, the rectangular box portion 110 and the tented box portion 120 also share a pair of side walls 140 on opposite sides of the bottom portion 130. The side walls 140 extend upward from the bottom portion 130 and are substantially rectangular in shape with a length approximately equal to the length of the bottom portion 130 and a height that is sized to accommodate a desired size bouquet of flowers, for example.

The example container 100 of FIGS. 1 and 2 is provided with a top cover 150 which includes a flat top portion 152 and a tented top portion 154. Thus, the rectangular box portion 110 is defined by the bottom support 130, the side walls 140 and the flat top portion 152 of the top cover 150, and the tented box portion 120 is defined by the bottom support 130, the side walls 140 and the tented top portion 154 of the top cover 150.

In various examples, the flat top portion 152 is formed with a single flap, an example of which is described below with reference to FIG. 4. The tented top portion 154 of the top portion 150 may be formed by two flaps which may be latched to form a tented shape above the tented box portion 120.

In order to accommodate flowers in the tented box portion 120 and stems in the rectangular box portion 110, the rectangular box portion 110 and the tented box portion 120 are communicatively coupled. In this regard, the rectangular box portion 110 and the tented box portion 120 are at least partly open to each other. In the example of FIGS. 1 and 2, an extension of the flat top portion 152 may extend into the example container 100 and form a tongue 156 which partially divides the rectangular box portion 110 and the tented box portion 120. The tongue 156 may serve to at least partially secure the stems in place, preventing at least some movement of the stems.

In various examples, one or more ends of the example container 100 may be open. For example, in the example of FIGS. 1 and 2, an end wall 190 may be provided on the rectangular box portion 110 of the example container 100, but the opposite end may not include any end wall. Thus, the end of the tented box portion 120 (the left end of FIGS. 1 and 2) may be open.

Figure 3:
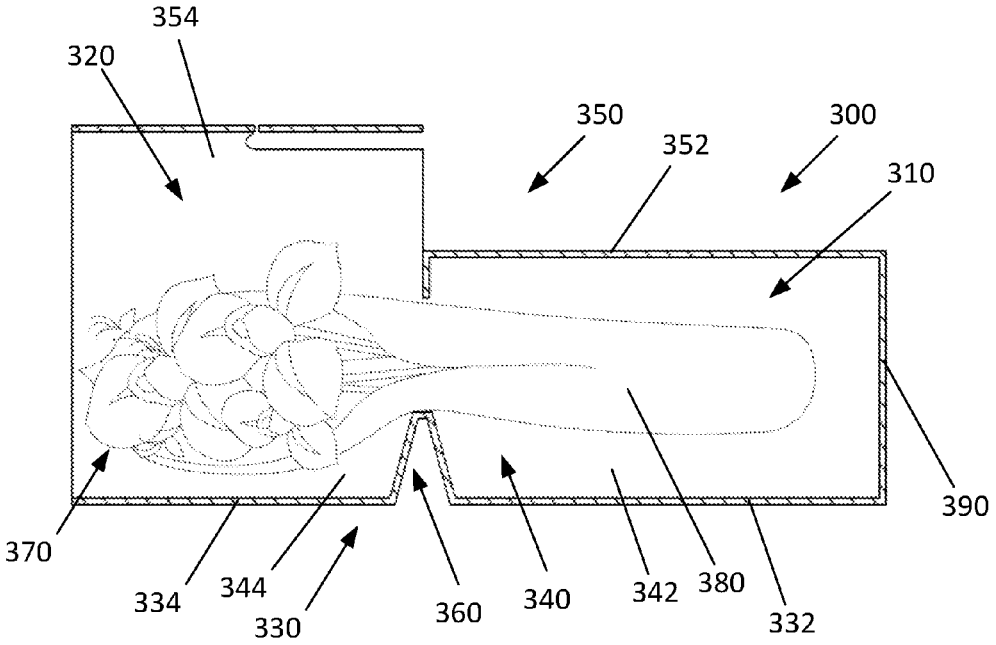
FIG. 3 illustrates a cross-sectional view of another example container.

Referring now to FIG. 3, a cross-sectional view of another example container 300 is illustrated. The example container 300 of FIG. 3 is similar to the example container 100 of FIG. 1 in many ways but is provided with a neck feature to more securely hold flowers therein. As illustrated in the cross-sectional view of FIG. 3, the example container 300 includes a rectangular box portion 310 and a tented box portion 320. The example container 300 includes a bottom support 330 that is divided into a rectangular box bottom support 332 and a tented box bottom support 334. Similarly, a pair of side walls 340 are each divided into a rectangular box side wall 342 and a tented box side wall 344.

The example container 300 of FIG. 3 is provided with a top cover 350 which includes a flat top portion 352 and a tented top portion 354. Thus, the rectangular box portion 310 is defined by the rectangular box bottom support 332, the rectangular box side walls 342 and the flat top portion 352 of the top cover 350, and the tented box portion 320 is defined by the tented box bottom support 334, the tented box side walls 344 and the tented top portion 354 of the top cover 350.

As described above with reference to FIGS. 1 and 2, one or more ends of the example container 300 may be open. For example, in the example of FIG. 3, an end wall 390 may be provided on the rectangular box portion 310 of the example container 300, but the opposite end may not include any end wall. Thus, the end of the tented box portion 320 (the left end of FIG. 3) may be open.

As with the example container 100 of FIGS. 1 and 2, in the example container 300 of FIG. 3, in order to accommodate flowers in the tented box portion 320 and stems in the rectangular box portion 310, the rectangular box portion 310 and the tented box portion 320 are communicatively coupled. In the example of FIG. 3, in addition to a tongue 356, the rectangular box portion 310 and the tented box portion 320 may be divided by a neck 360. As illustrated in FIG. 4, the neck 360 may provide support for stems 380 of flowers 370 stored in the example container 300. In this regard, the neck 360 may either suspend the flowers 370 above the tented box bottom support 334 or at least decrease the pressure on the flowers 370 which may be resting on the tented box bottom support 334. Further, in various examples, the neck 360 and the tongue 356 may combine to prevent or reduce movement of the stems during transport of the example container 300.

The example containers 100, 300 described above may be formed using various materials including, but not limited to, cardboard and plastic. In one example, the example containers 100, 300 may be formed of a single sheet of material. An example template 400 from which the example container 300 of FIG. 3 may be formed is illustrated in FIG. 4.

As noted above, the example template 400 may be a single sheet of any of a variety of materials. In one example, the example template 400 is formed of a cardboard material. The example template 400 includes various surfaces separated by fold lines. Folding the material along the fold lines produces the various features of the example container 300 described above with reference to FIG. 3.

Figure 4:
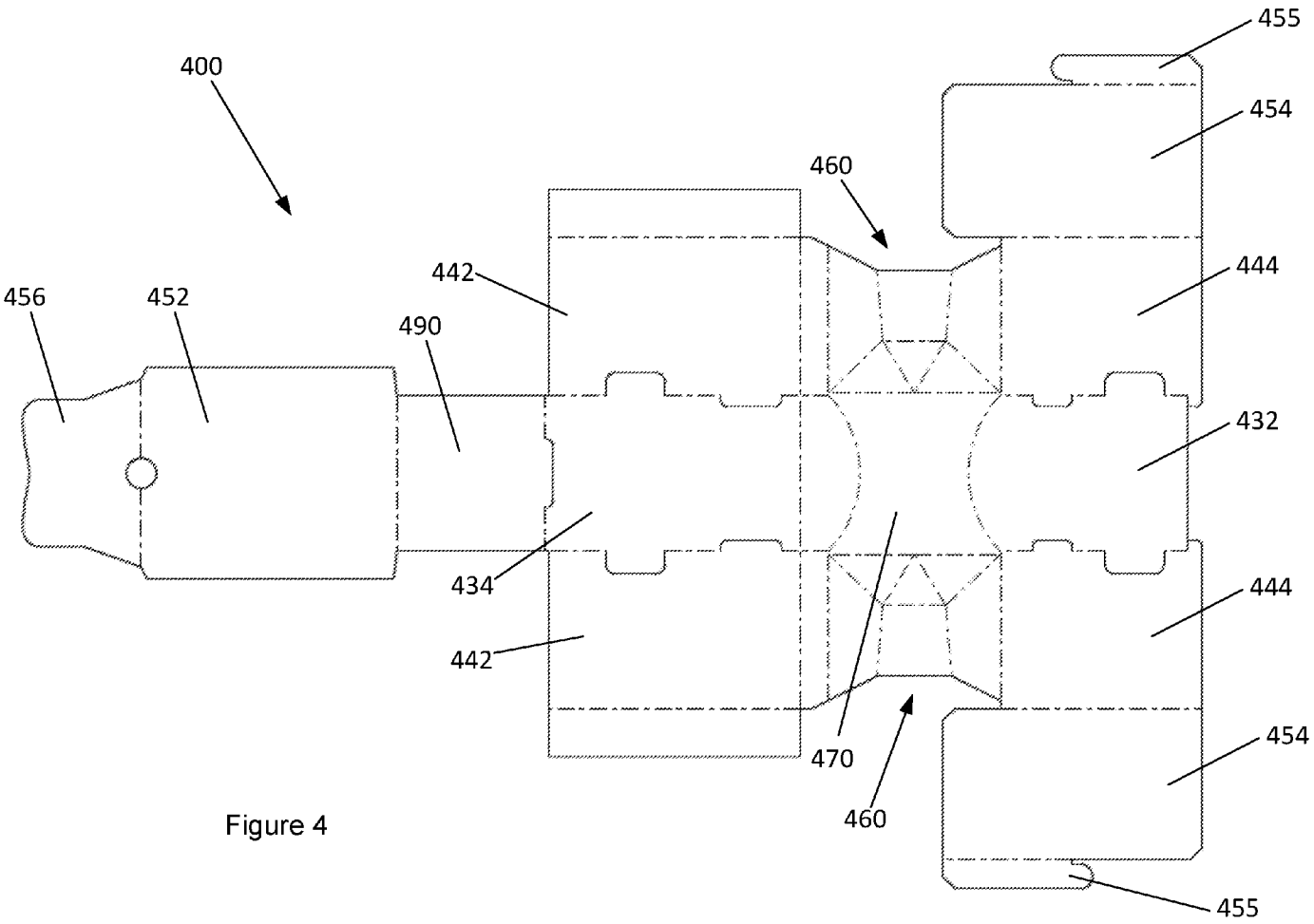
FIG. 4 illustrates a template from which the example container of FIG. 3 may be formed.

Thus, referring now to FIGS. 3 and 4, the example template 400 includes bottom portion areas 432 and 434 which form the rectangular box bottom support 332 and the tented box bottom support 334, respectively. Further, the example template 400 includes side surfaces 442 and 444 which form the rectangular box side walls 342 and the tented box side walls 344 respectively. In this regard, the side surfaces 442 and 444 may be folded to a position that is substantially perpendicular to the bottom portion areas 432 and 434 along fold lines separating the bottom portion areas 432, 434 from the side surfaces 442, 444.

Further, the end wall 390 of the example container 300 may be formed by an end surface 490 provided on the example template 400. In this regard, the end surface 490 may be folded substantially perpendicular to the bottom portion area 434 along a fold line separating one end of the end surface 490 from the bottom portion area 434. Further, an opposing end of the end surface 490 may be separated from a flat top surface 452 by a fold line. Folding the flat top surface 452 along this fold line to a position that is substantially perpendicular to the end surface 490 forms the flat top portion 352 of the example container 300. Thus, the flat top portion 352 is substantially parallel to the rectangular box bottom support 332 and spaced apart by the end wall 390. Further, an opposing end of the flat top surface 452 extends to a tongue surface 456 which may be folding along a fold line to form the tongue 356.

The example template 400 includes tented top flaps 454 which extend from each side surface 444. The tented top flaps 454 may be folded along fold lines separating the tented top flaps 454 from the side surfaces 444 to form an angle that is greater than 90 degrees. Thus, the two tented top flaps 454 may collectively form the tented top portion 354 of the example container 300. The two tented top flaps 454 may be provided with opposing tabs 455 which may interlock to form a latch in the tented top portion 354.

In the example of FIG. 4, the example template 400 may be provided with a neck side region 460 separating the side surfaces 442 from the side surfaces 444 and a neck bottom region 470 separating the bottom portion area 432 from the bottom portion area 434. The neck side region 460 and the neck bottom region 470 include various fold lines and surfaces. The neck side region 460 and the neck bottom region 470 may be pressed or folded inward to form the neck 360 of the example container 300 of FIG. 3. Thus, the neck 360 may be formed with the folds of the single sheet of material.

Figure 5:
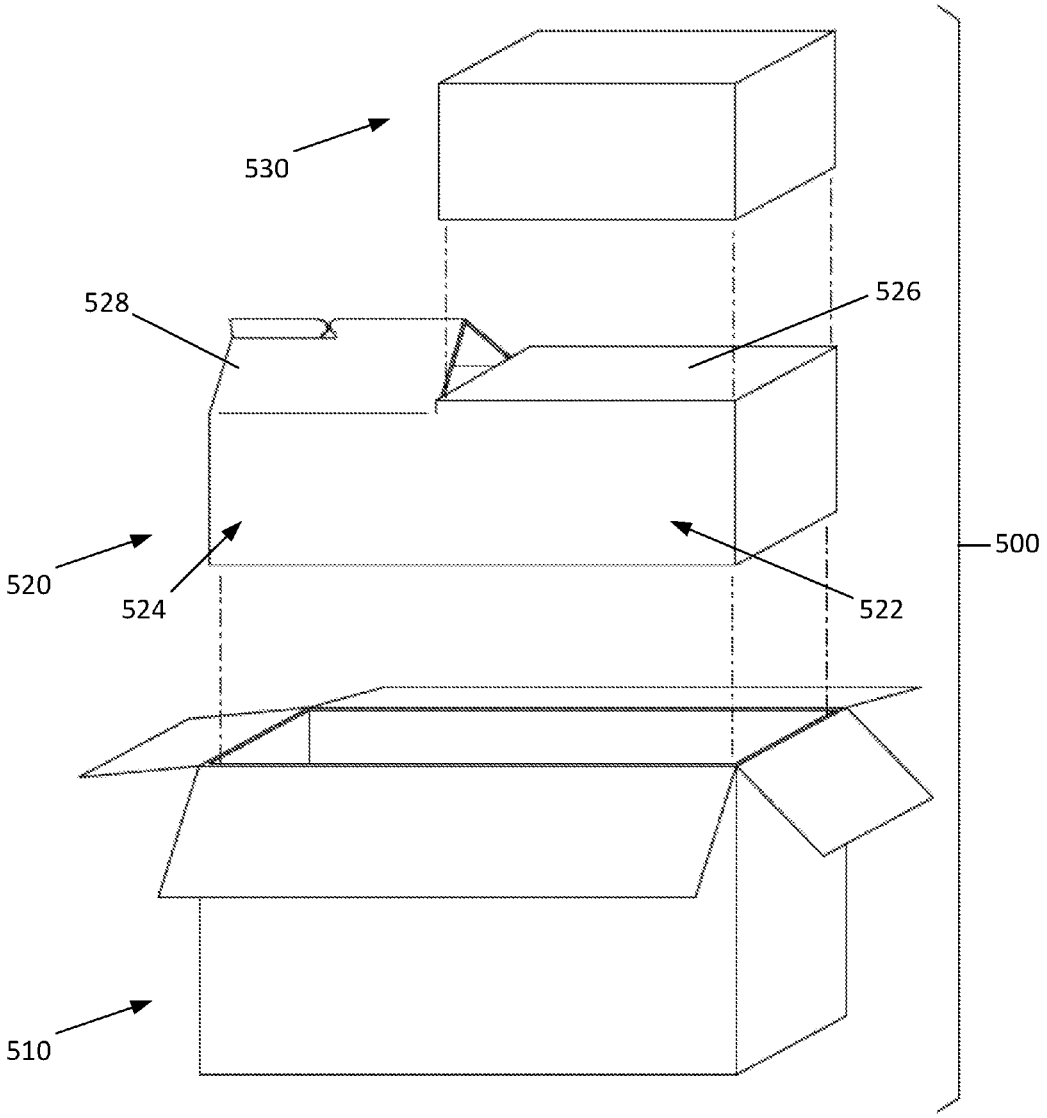
FIG. 5 illustrates an example container system before assembly.
Figure 6:
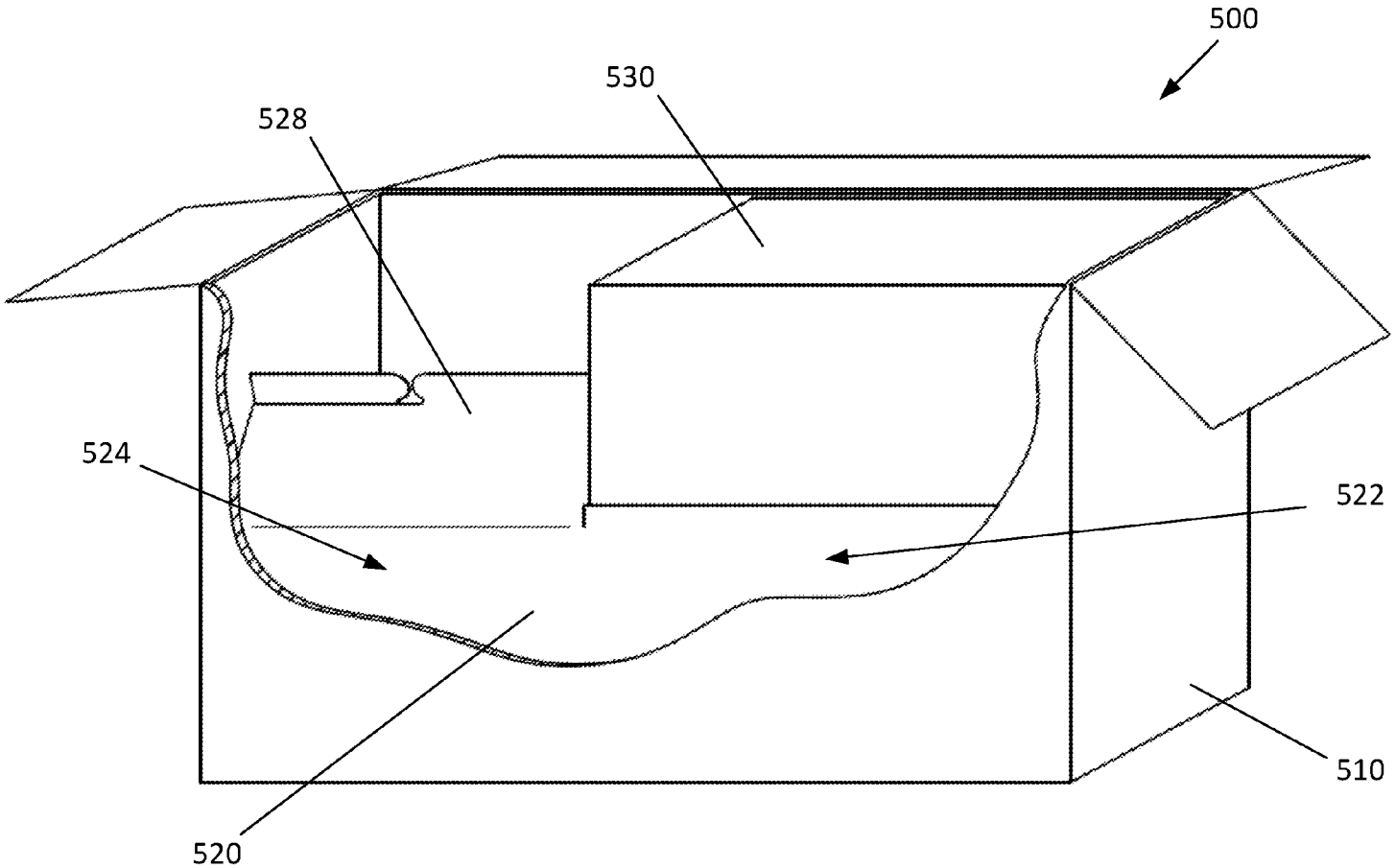
FIG. 6 illustrates the example container system of FIG. 5 after assembly.

In various examples, the example containers 100, 300 described above may be used as part of a system of containers used to ship multiple products. An example container system 500 is illustrated in FIGS. 5 and 6. FIG. 5 illustrates the example container system 500 before assembly, and FIG. 6 illustrates the example container system 500 after assembly.

The example container system 500 includes an outside box 510, an inner container 520 and an accessory box 530. In various examples, the outside box 510 may be a rectangular box sufficiently large to hold various components of the system 500 therein. The inner container 520 may be similar to the example containers 100, 300 described above with reference to FIGS. 1-4. In this regard, the inner container 520 includes a rectangular box portion 522 and a tented box portion 524. As described in the examples above, the rectangular box portion 522 is provided with a flat top 526, and the tented box portion 524 is provided with a tented top 528. The accessory box 530 may be a box of any shape that is sufficiently small to fit on the flat top 526 of the inner container 520.

When assembled, as illustrated in the cut-away illustration of FIG. 6, the inner container 520 may be positioned within the outside box. In one example, the inner container 520 and the outside box 510 are sized such that the inner container 520 fits inside the outside box 510 with only a small clearance, thus preventing undesirable sliding or other movement of the inner container 520 within the outside box 510.

The accessory box 530 may then be positioned within the outside box 510 to rest on top of the flat top 526 of the inner container 520. In one example, the accessory box 530 is sized to have a footprint that is substantially the same the dimensions as the flat top 526 of the inner container 520. Thus, the accessory box 530 may be secured in place by the sides of the outside box 510 on three sides and the tented top 528 of the inner container 520 on the fourth side. Thus, the tented top 528 of the inner container 520 may prevent lateral movement of the accessory box 530 positioned on the flat top 526.

In various examples, the container system 500 of FIGS. 5 and 6 may be used to ship a combination of items which may be desirably matched. For example, the inner container 520 may be used to house flowers, and the accessory box 530 may be used to house strawberries or chocolates. In this regard, the accessory box 530 may also be provided with an ice pack therein.

The outside box 510 may then be closed to secure the contents therein. While additional packing materials, such as foam peanuts, may be provided, various features of the container system 500 may render them unnecessary. For example, the tented top 528 may protect the flowers therein from any shock in the event of an object being dropped on the inner container 520. Further, as noted above, the tented top 528 may serve to secure the accessory box 530 in place, eliminating or reducing the need for packing materials that may otherwise be needed for that purpose.

The various examples set forth herein are described in terms of example block diagrams, flow charts and other illustrations. Those skilled in the art will appreciate that the illustrated examples and their various alternatives can be implemented without confinement to the illustrated examples. For example, block diagrams and their accompanying description should not be construed as mandating a particular architecture or configuration.

What is claimed is:

1. A container, comprising:

a bottom support;

a plurality of side walls; and a top cover, the top cover including a flat portion and a tented portion, wherein the flat portion of the top cover, the bottom support and a first portion of the side walls form a rectangular box portion, wherein the tented portion of the top cover, the bottom support and a second portion of the side walls form a tented box portion, wherein the rectangular box portion and the tented box portion are in communication with one another, wherein the rectangular box portion and the tented box portion are at least partially divided by a neck, the neck being to support flower stems, and wherein the bottom support and the side walls are formed of a single sheet of material, and wherein the neck is formed with folds of the single sheet of material, the folds being in the bottom support and the side walls.

2. A container, comprising:

a rectangular box portion having a flat top; and a tented box portion having a tented top;

wherein the rectangular box portion and the tented box portion are communicatively coupled, wherein the rectangular box portion is defined by a bottom support, a first portion of a plurality of side walls and the flat top, wherein the tented box portion is defined by the bottom support, a second portion of the side walls and the tented top, wherein the rectangular box portion and the tented box portion are at least partially divided by a neck, the neck being to support flower stems, wherein bottom support and the side walls are formed of a single sheet of material, and wherein the neck is formed with folds of the single sheet of material, the folds being in the bottom support and the side walls.

3. A container system, comprising:

an outside box;

an inner container positioned within the outside box, the inner container having a rectangular box portion with a flat top and a tented box portion with a tented top; and an accessory box positioned within the outside box and supported by the flat top of the rectangular box portion of the inner container, wherein the tented top prevents lateral movement of the accessory box on the flat top.

4. The container system of claim 3, wherein the rectangular box portion is defined by a bottom support, a plurality of side walls and the flat top, and wherein the tented box portion is defined by the bottom support, the side walls and the tented top.

5. The container system of claim 3, wherein the rectangular box portion and the tented box portion are at least partially divided by a tongue extending from the flat top.

6. The container system of claim 3, wherein the rectangular box portion and the tented box portion are at least partially divided by a neck, the neck being to support flower stems.

7. The container system of claim 6, wherein the rectangular box portion is defined by a bottom support, a plurality of side walls and the flat top, and wherein the tented box portion is defined by the bottom support, the side walls and the tented top.

8. The container system of claim 7, wherein bottom support and the side walls are formed of a single sheet of material, and wherein the neck is formed with folds of the single sheet of material, the folds being in the bottom support and the side walls.

* * * * *